US010578381B2

(12) United States Patent
DiChario et al.

(10) Patent No.: US 10,578,381 B2
(45) Date of Patent: Mar. 3, 2020

(54) UPPER RECEIVER FOR MODULAR SHOTGUN

(71) Applicant: American Tactical, Inc., Summerville, SC (US)

(72) Inventors: Anthony DiChario, Eutawville, SC (US); Raymond J. Caton, Rochester, NY (US); Roger Ellison Cribb, St. George, SC (US)

(73) Assignee: American Tactical, Inc., Summerville, SC (US)

( * ) Notice: Subject to any disclaimer, the term of this patent is extended or adjusted under 35 U.S.C. 154(b) by 0 days.

(21) Appl. No.: 16/251,480

(22) Filed: Jan. 18, 2019

(65) Prior Publication Data

US 2019/0226776 A1 Jul. 25, 2019

Related U.S. Application Data

(60) Provisional application No. 62/620,439, filed on Jan. 22, 2018.

(51) Int. Cl.
*F41A 5/00* (2006.01)
*F41A 3/66* (2006.01)
(Continued)

(52) U.S. Cl.
CPC *F41A 3/66* (2013.01); *F41A 3/26* (2013.01); *F41A 5/18* (2013.01); *F41A 5/20* (2013.01);
(Continued)

(58) Field of Classification Search
CPC ..... F41A 3/88; F41A 5/18; F41A 5/20; F41A 5/22; F41A 3/66; F41A 11/02
See application file for complete search history.

(56) References Cited

U.S. PATENT DOCUMENTS 2,252,754 A * 8/1941 Browning ..... F41A 5/20 89/193
2,494,889 A * 1/1950 Maillard ..... F41A 5/22 89/193
(Continued)

FOREIGN PATENT DOCUMENTS

CA 2912894 5/2017
CH 300987 A * 8/1954 ..... F41A 5/30
(Continued)

*Primary Examiner* — Gabriel J. Klein
(74) *Attorney, Agent, or Firm* — Woods Oviatt Gilman LLP; Katherine H. McGuire, Esq.

(57) ABSTRACT

An upper receiver and barrel assembly includes an upper receiver, a barrel assembly and a gas piston assembly. An upper receiver housing receives a shotgun shell cartridge and the bolt carrier group includes a bolt carrier, a bolt within the bolt carrier, a firing pin and an ejector pin to expel fired shells. The barrel assembly includes a barrel, a barrel extension and a barrel nut to secure the barrel and barrel extension to the upper receiver housing. The gas piston assembly includes a piston body, a piston end cap and a piston bonnet configured to slidably receive the piston end cap therein. A piston gap is defined between the piston end cap and the bonnet end wall. The barrel defines a gas port fluidly connecting the open bore of the barrel with the piston gap. A biasing member urges the piston toward the bonnet.

16 Claims, 10 Drawing Sheets

(51) Int. Cl.

| | |
|---|---|
| ***F41A 11/02*** | (2006.01) |
| ***F41A 3/26*** | (2006.01) |
| ***F41A 5/20*** | (2006.01) |
| ***F41A 5/18*** | (2006.01) |
| ***F41A 15/14*** | (2006.01) |
| ***F41A 21/48*** | (2006.01) |

(52) U.S. Cl.
CPC ..... *F41A 11/02* (2013.01); *F41A 15/14* (2013.01); *F41A 21/48* (2013.01)

(56) References Cited

U.S. PATENT DOCUMENTS

| | | | | | |
|---|---|---|---|---|---|
| 3,619,926 | A * | 11/1971 | Alday | ..... | F41A 35/02 42/16 |
| 3,961,436 | A * | 6/1976 | Hagen | ..... | F41A 5/18 42/75.02 |
| 4,389,920 | A * | 6/1983 | Dufour, Sr. | ..... | F41A 5/18 89/190 |
| 4,930,399 | A * | 6/1990 | Trevor, Jr. | ..... | F41A 3/46 89/185 |
| 9,261,314 | B1 * | 2/2016 | Jackson | ..... | F41A 5/26 |
| 9,664,469 | B2 | 5/2017 | Dichario | | |

FOREIGN PATENT DOCUMENTS

| | | | | | |
|---|---|---|---|---|---|
| EP | 2783181 | | 9/2017 | | |
| WO | WO-2013136112 | A2 * | 9/2013 | ..... | F41A 5/20 |

* cited by examiner

UPPER RECEIVER FOR MODULAR SHOTGUN

FIELD OF THE INVENTION

The present invention relates to a modular assault-type shotgun, and more particularly, to an upper receiver for a modular assault-type shotgun configured to be used with a lower receiver of an automatic or semi-automatic assault-type rifle. Specifically, the present invention relates to a modified military specification (mil-spec) upper receiver configured for use with a mil-spec lower receiver of an M-16/AR-15 firearm to create a modular assault-type shotgun.

BACKGROUND OF THE INVENTION

There are a number of available automatic and semi-automatic firearms for use by military personnel and civilians. While fully automatic firearms are generally illegal for use by the civilian population, many of the components which constitute an automatic firearm are the same as those found within legal semi-automatic models. Arguably the most popular semi-automatic assault-type firearm used by civilians, particularly within the United States, is the AR-15. The AR-15 is the semi-automatic variant of the fully automatic M16 firearm used by United States military personnel. While AR-15 is a registered trademark of Colt Industries, a number of additional manufacturers manufacture clones of the AR-15 and market these clones under separate trademarks. While used throughout the specification, it is to be understood that the term AR-15 is meant to include not only those firearms manufactured by Colt Industries, but also those additional clones and any variants thereof.

The AR-15 and M16 are designed as modular rifles generally comprising a buttstock, lower receiver, upper receiver and barrel assembly configured to fire .223 Remington or 5.56×45 mm NATO military ammunition. Each component is separable from one another and affords firearm owners the opportunity to customize the firearm with after-market components such as barrels of differing lengths, upper receivers designed to handle different calibers of rifle ammunition, flashlights, hand guards, grenade or flare launchers, flash or sound suppressors, grips, and front or rear sights. To operate, the lower receiver is configured to include a trigger wherein activation of the trigger causes a rifle cartridge housed within the chamber of the upper receiver to be fired out the barrel of the firearm by action of a reciprocating bolt carrier group. Internal mechanisms of the upper receiver expel the shell casing of the fired rifle cartridge from the chamber while components engaged with the magazine housed within the magazine well of the lower receiver feed a new rifle cartridge into the now-empty chamber. The buttstock mounts to the lower receiver and includes a buffer assembly and action (or recoil) spring in communication with the bolt carrier group where the spring pushes the bolt carrier group back toward the chamber in preparation of firing another rifle cartridge.

To date, most automatic and semi-automatic firearms, like the AR-15, have been configured to fire rifle cartridges only. Attempts to modify these firearms, and particularly the AR-15, to fire shotgun shells have run into a number of problems. For instance, AR-15s have been modified to accommodate .410 bore shells but these modifications require lower receivers which no longer satisfy military specifications (mil-spec). Other modifications continue to result in jamming or binding of the shotgun shell cartridges when a cartridge has been fired, its shell is being ejected, or a new cartridge is being extracted from the magazine and loaded within the chamber. To that end, Applicant has produced a shotgun shell magazine configured to feed shells from the magazine into a mil-spec AR-15/M16 lower receiver (see commonly owned U.S. Pat. No. 9,664,469 (the '469 Patent) issued May 30, 2017, the entirety of which is incorporated by reference herein). Nevertheless, the direct impingement mechanism used within many assault-type rifles (including the M16/AR-15) may hinder or prevent proper ejection of the fired shotgun shell, or may fail to properly cycle the bolt carrier assembly during ejection and extraction.

As such, there is a need for an upper receiver and barrel assembly which is configured to mount to a lower receiver, wherein fired shotgun shells may be efficiently ejected after firing while also properly extracting the next successive shotgun shell from the magazine upon proper cycling of the bolt carrier assembly. There is a further need for a modified M16/AR-15 upper receiver configured to mount to a mil-spec M16/AR-15 lower receiver and automatically or semi-automatically fire .410 bore shotgun shells. The present invention addresses these and other needs.

BRIEF SUMMARY OF THE INVENTION

In general, an embodiment the present invention is directed to an upper receiver and barrel assembly configured to mount to a lower receiver and receive and fire a shotgun shell. The upper receiver and barrel assembly comprises an upper receiver, a barrel assembly and a gas piston assembly. The upper receiver comprises an upper receiver housing defining a chamber configured to receive the shotgun shell therein and a bolt carrier group. The bolt carrier group includes a bolt carrier slidably received within the upper receiver housing, wherein the bolt carrier travels from a forward position to a rearward position upon firing of the shotgun shell; a bolt received within the bolt carrier; a firing pin configured to strike a primer end of the shotgun shell when the bolt carrier is in the forward position; and an ejector assembly including an ejector pin and ejector hook, wherein the ejector assembly is configured to expel the fired shotgun shell from the chamber when the bolt carrier travels to the rearward position. The barrel assembly comprises a barrel having a receiver end and a muzzle end and a tubular sidewall defining an open bore; a barrel extension coupling the receiver end of the barrel to the upper receiver housing; and a barrel nut adapted to releasably secure the barrel and barrel extension to the upper receiver housing. The gas piston assembly comprises a piston body having a first end and a second end, wherein the first end of the piston body includes a tab slidably received within a corresponding slot defined by the barrel extension; a piston end cap coupled to the second end of the piston body; a piston bonnet having a bonnet end wall and a sidewall configured to slidably receive the piston end cap therein, wherein the piston bonnet is secured to the barrel an intermediate distance between the receiver end and the muzzle end of the barrel, wherein a piston gap is defined between the piston end cap and the bonnet end wall, and wherein the barrel sidewall defines a gas port fluidly connecting the open bore of the barrel with the piston gap; and a biasing member urging the piston body and piston end cap toward the bonnet end wall.

Additional objects, advantages and novel features of the present invention will be set forth in part in the description which follows, and will in part become apparent to those in the practice of the invention, when considered with the attached figures.

BRIEF DESCRIPTION OF THE DRAWINGS

The accompanying drawings form a part of this specification and are to be read in conjunction therewith, wherein like reference numerals are employed to indicate like parts in the various views, and wherein.

DETAILED DESCRIPTION OF THE INVENTION

Figure 1:
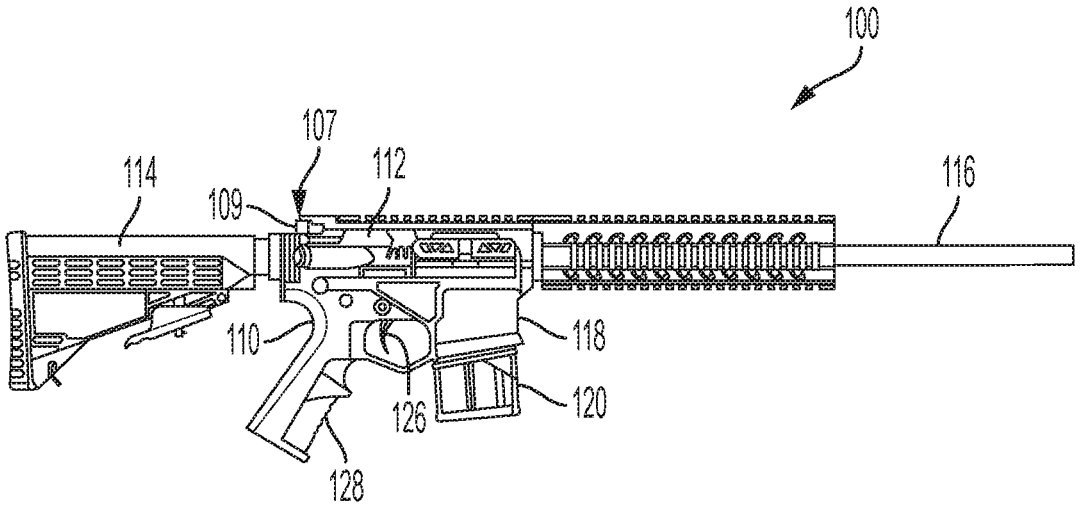
FIG. 1 is a side view of a prior art modular firearm.
Figure 2:
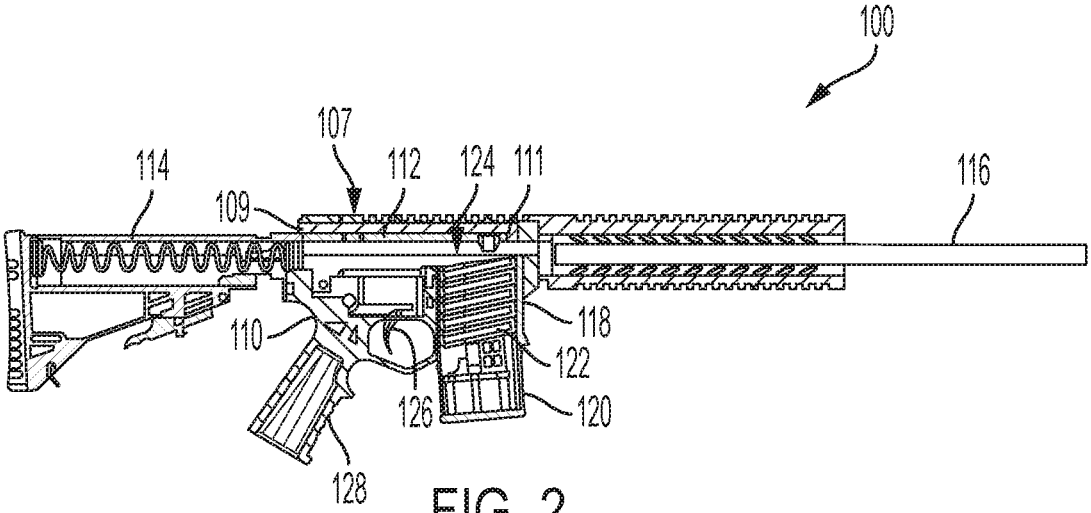
FIG. 2 is a side cross-section view of the prior art modular firearm shown in FIG. 1.
Figure 3:
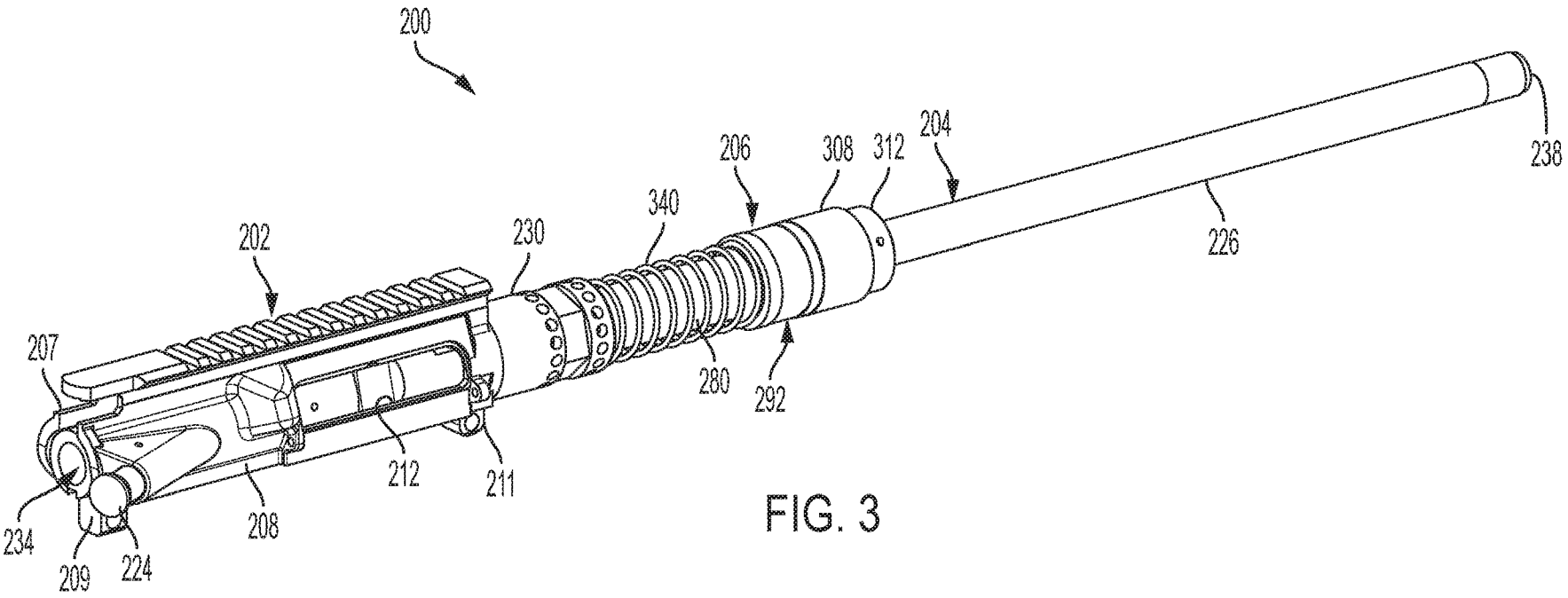
FIG. 3 is a perspective view of an exemplary upper receiver and barrel assembly in accordance with an aspect of the present invention.
Figure 4:
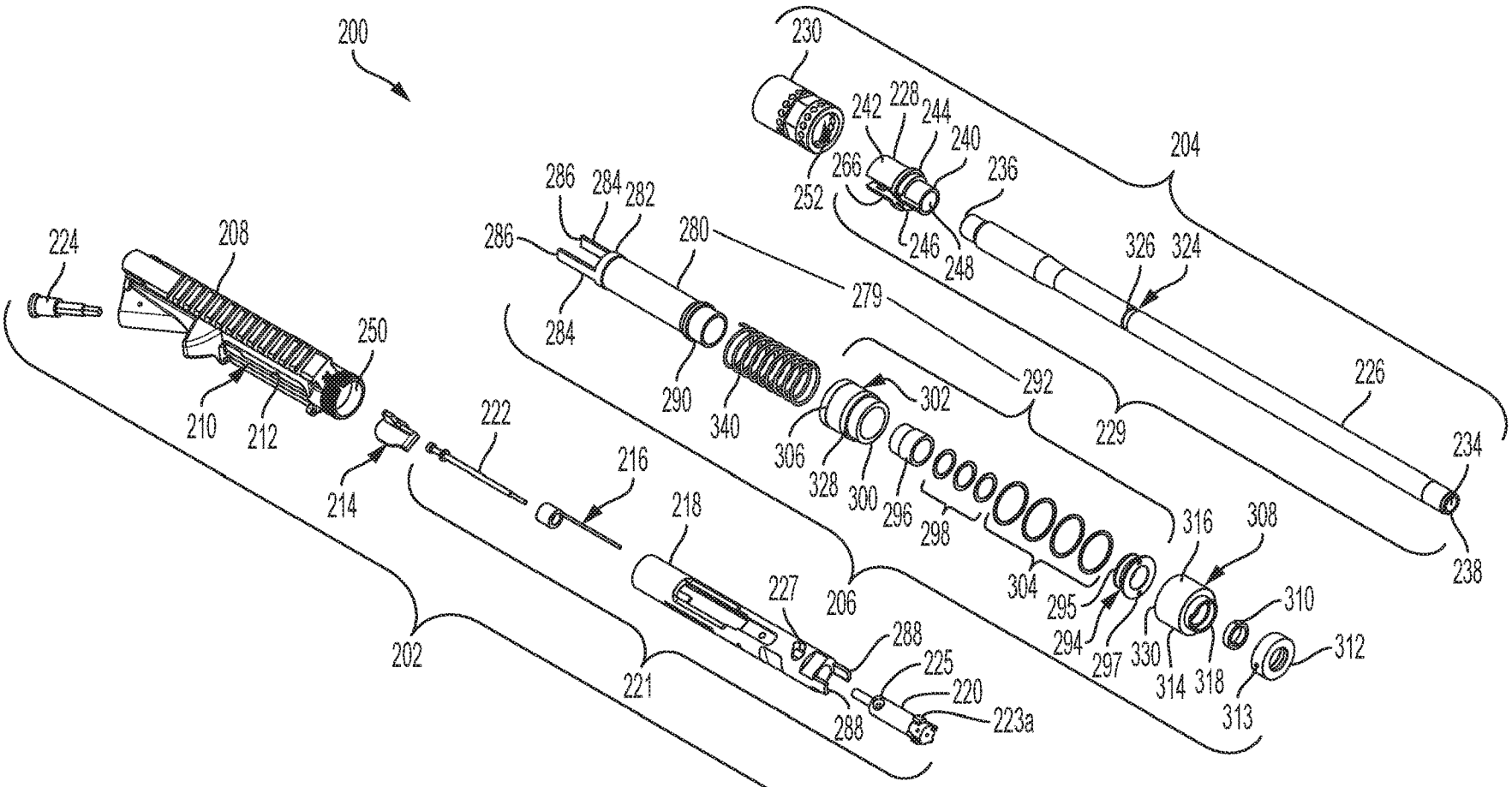
FIG. 4 is an exploded view of the exemplary upper receiver and barrel assembly shown in FIG. 3.

Referring to the drawings in detail, and specifically to FIGS. 1 and 2, a prior art firearm, such as the AR-15, is generally indicated by reference numeral 100. Firearm 100 may be a modular firearm consisting of a number of components and subcomponents. Major components of firearm 100 may include lower receiver assembly 110, upper receiver assembly 112, buttstock assembly 114 and barrel assembly 116. To assemble a completed firearm, upper receiver assembly 112 is coupled to lower receiver assembly 110 while buttstock assembly 114 is connected to the lower receiver assembly 110 and barrel assembly 116 is mounted onto upper receiver assembly 112. Lower receiver assembly 110 is configured to include a magazine well 118 adapted to slidably receive a magazine 120 therein. Magazine 120 may carry one more cartridges, bullets or shells 122 which may be serially loaded within a chamber 124 in upper receiver assembly 112. Activation of the firing mechanism (not shown) is controlled by trigger 126. A grip 128 (such as a pistol grip, as shown) allows the user to aim and control the firearm while placing the user's trigger index finger in close proximity to the trigger. In this manner, the user can aim the firearm to the target and extend the trigger index finger to engage the trigger without losing control or accuracy of the firearm. A charging handle assembly 107 including a charging handle 109 and release/retaining lever 111 is provided for opening and controlling a bolt carrier group (not shown) for maintenance, loading the first live unfired cartridge into chamber 124 and removing a live unfired cartridge from the chamber, as is known in the art.

Most assault-type firearms are configured to be operated as rifles and include a rifled barrel and are chambered to receiver and fire rifle cartridges. By way of example, the most ubiquitous civilian assault weapon, the AR-15, is generally chambered for standardized rounds such as the Remington .223 cartridge or the 5.56×45 mm NATO military cartridge. The major components of the AR-15 have been standardized, with such standardization being generally referred to as meeting United States Military Standards or, more commonly as being "mil-spec". Specifically, as used herein, the terms "mil-spec" and "mil-spec M16/AR-15" shall refer to the structural specificities defined by the United States Department of Defense as of Jan. 23, 2018 the date of filing of U.S. provisional patent application Ser. No. 62/620,439.

Assault weapons, such as the AR-15, have also been modified to chamber and fire .410 bore shotgun shells. However, these firearms suffer from a number of drawbacks. For instance, 2.5 inch long shotgun shells tend to bind within the chamber and/or magazine thus leading to performance failures. In an attempt to alleviate these binding issues, firearms have been modified such that the magazine well of the lower receiver is slightly larger than the standard AR-15 magazine well such that the larger magazine well can receive a larger magazine such that the shotgun shells can be more repeatably extracted from the magazine and chambered within the upper receiver. This modification, however, renders the lower receiver assembly no longer mil-spec and also leads to difficulties when mating the upper and lower receivers. While the magazine which is the subject of the '469 Patent addresses these issues by providing a magazine which may be mounted within a mil-spec AR-15 lower receiver, efficient ejection of fired shotgun shells and proper cycling of the bolt carrier assembly may be enhanced by a modified mil-spec AR-15 upper receiver and barrel assembly as described below.

To that end and with reference to FIGS. 3-10, an exemplary upper receiver and barrel assembly 200 in accordance with an aspect of the present invention may generally comprise an upper receiver 202, barrel assembly 204 and gas piston assembly 206. In one aspect of the present invention, upper receiver 202 includes an AR-15 upper receiver body 208 configured to mount to a mil-spec AR-15 lower receiver body. To that end, upper receiver body 208 includes first and second nodules 209, 211 proportioned to rest within a notch or groove formed within the sidewalls of the mil-spec AR-15 lower receiver body (not shown). Each nodule and respective sidewall includes corresponding through-holes whereby a respective pin (not shown) may be inserted within each corresponding through-hole to secure the two receiver bodies together.

Upper receiver body 208 may originate as a mil-spec AR-15 upper receiver but may be modified so as to define a chamber 210 that has been proportioned to accommodate 2.5 inch long .410 bore shotgun shell cartridges. Ejection port 212 may also be enlarged in relation to a mil-spec AR-15 upper receiver configured to fire rifle cartridges so as to provide additional clearance for ejection of the longer 2.5 inch .410 bore shotgun cartridge casings when compared to the shorter 1.76 inch long .223 Remington (5.56×45 mm NATO) rifle cartridge casings. In a further aspect of the present invention, upper receiver body 208 may be further modified to include provision of ejector hook 214 configured to engage an ejector pin 216 carried by bolt carrier group 221 as will be discussed in greater detail below. Upper receiver body 208 may also include a notched portion 207 configured to receive a charging handle assembly, such as charging handle assembly 107 described above with reference to FIGS. 1 and 2.

Figure 6:
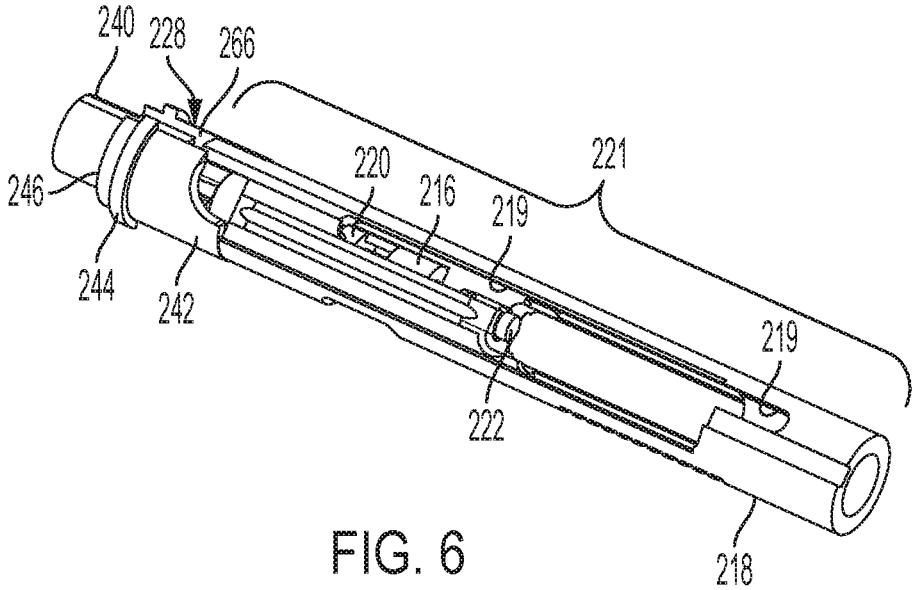
FIG. 6 is a perspective view of a bolt carrier group and barrel extension suitable for use within the exemplary upper receiver and barrel assembly shown in FIG. 3.
Figure 7:
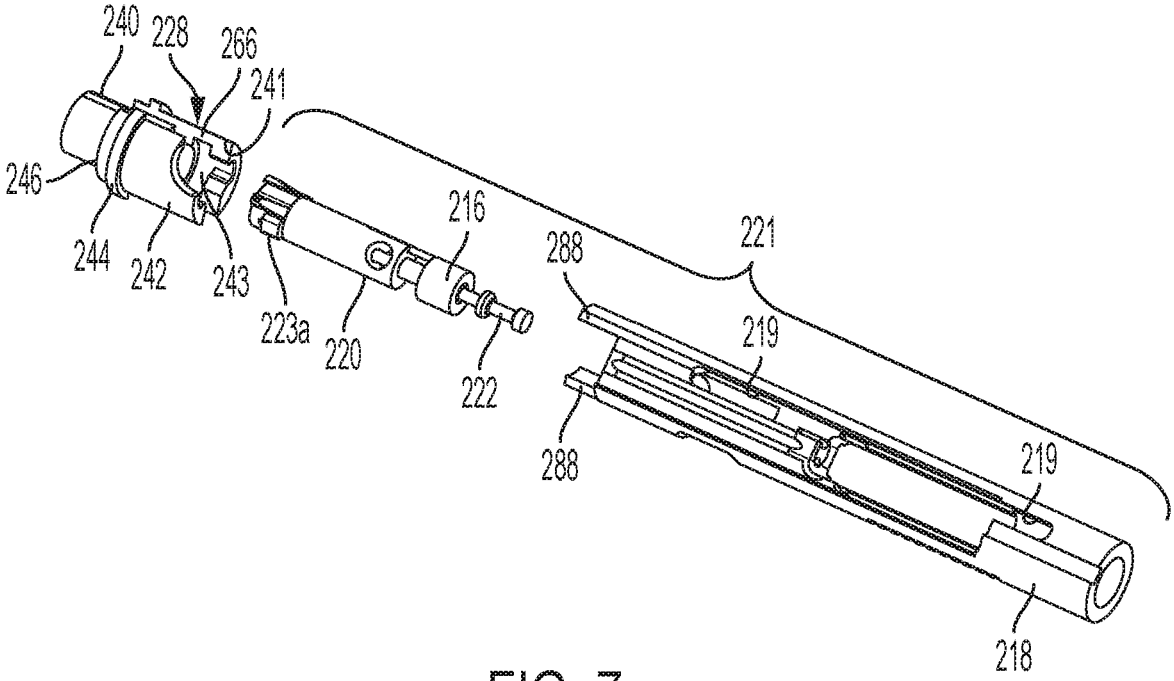
FIG. 7 is an exploded view of the bolt carrier group and barrel extension shown in FIG. 6.

With additional reference to FIGS. 6 and 7, upper receiver housing 208 receives bolt carrier group 221 therein. Bolt carrier group 221 may generally comprise bolt carrier 218, bolt 220, firing pin 222 and ejector pin 216. Bolt carrier 218 may also include a groove 219 within which translates ejector hook 214 when bolt carrier group 221 cycles during operation, as will be discussed in greater detail below. Upper receiver housing 208 may also include a forward assist 224 configured to manually advance bolt carrier 218 to its forward position, if necessary, as is known in the art.

Figure 8:
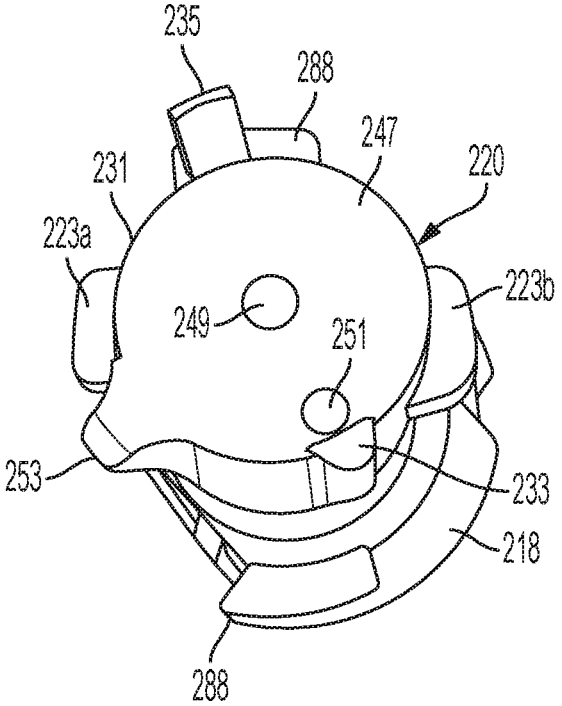
FIG. 8 is a top perspective view of bolt suitable for use within the exemplary upper receiver and barrel assembly shown in FIG. 3.
Figure 9:
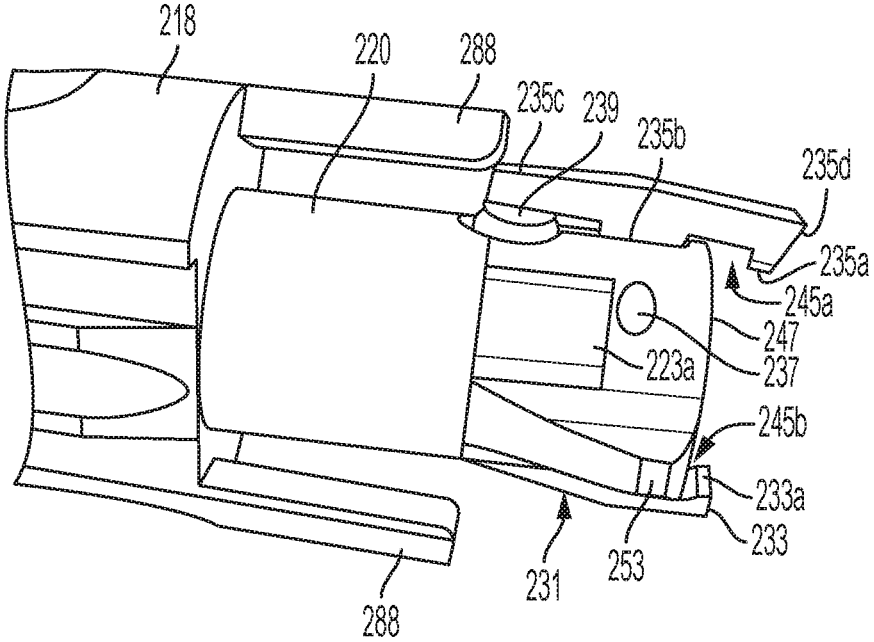
FIG. 9 is a side view of the bolt shown in FIG. 8.

With further reference to FIGS. 8 and 9, the distal end of bolt 220 may include a bolt head 231 configured to extract and eject shotgun shell cartridges, as well as lock and unlock within barrel extension 228, as will be discussed in greater detail below. To that end, bolt head 231 may include a cartridge guide 233 and opposing cartridge extractor 235. Cartridge guide 233 may be integrally formed with bolt head 231. Extractor 235 may generally comprise a T-shaped member, wherein the vertical trunk 235*b* is pivotally received within a cavity within the body of bolt head 231 via an extractor pin 237. Proximal end 235*c* is configured to overlap extractor spring 239 whereby distal end 235*d* is biased toward extractor 233. Cartridge guide 233 and extractor 235 may each include a respective hook 233*a*, 235*a* projecting inwardly toward the center of bolt head 231. Hooks 233*a*, 235*a* thereby define a rim gap 245*a*, 245*b* between each hook and face 247 of bolt head 231. Bolt head 231 also defines a firing pin through bore 249 within which firing pin 222 may translate and an ejector through bore 251 within which translates ejector pin 216. The operation of each of these features will be described in greater detail below.

Coupled to upper receiver 202 is barrel assembly 204. Barrel assembly 204 may include barrel 226, barrel extension 228 and barrel nut 230. Barrel 226 comprises a generally tubular sidewall 232 defining an open bore 234 extending the length of barrel 226 from receiver end 236 to muzzle end 238. Barrel extension 228 comprises a separate tubular member having a stepped outer wall thereby delineating barrel extension 228 into a barrel receiving portion 240 and bolt receiving portion 242. Bolt receiving portion 242 includes an external annular ring 244 proximate step 246. Receiver end 236 of barrel 226 may include male threads configured to engage corresponding female threads defined within inner wall surface 248 of barrel receiving portion 244 of barrel extension 228 so as to form a unitary barrel member 229. Bolt receiver portion 242 of barrel extension 228 may then slide within the forward barrel receiving end 250 of upper receiver body 208 to mount barrel member 229 to upper receiver body 208. As shown most clearly in FIG. 7, inner wall surface 241 of bolt receiver portion 242 may include one or more generally T-shaped grooves 243 configured to lockingly receive detents 223 on bolt 220 as bolt 220 is rotated into the forward position via bolt cam 225 riding within carrier slot 227.

Figure 10:
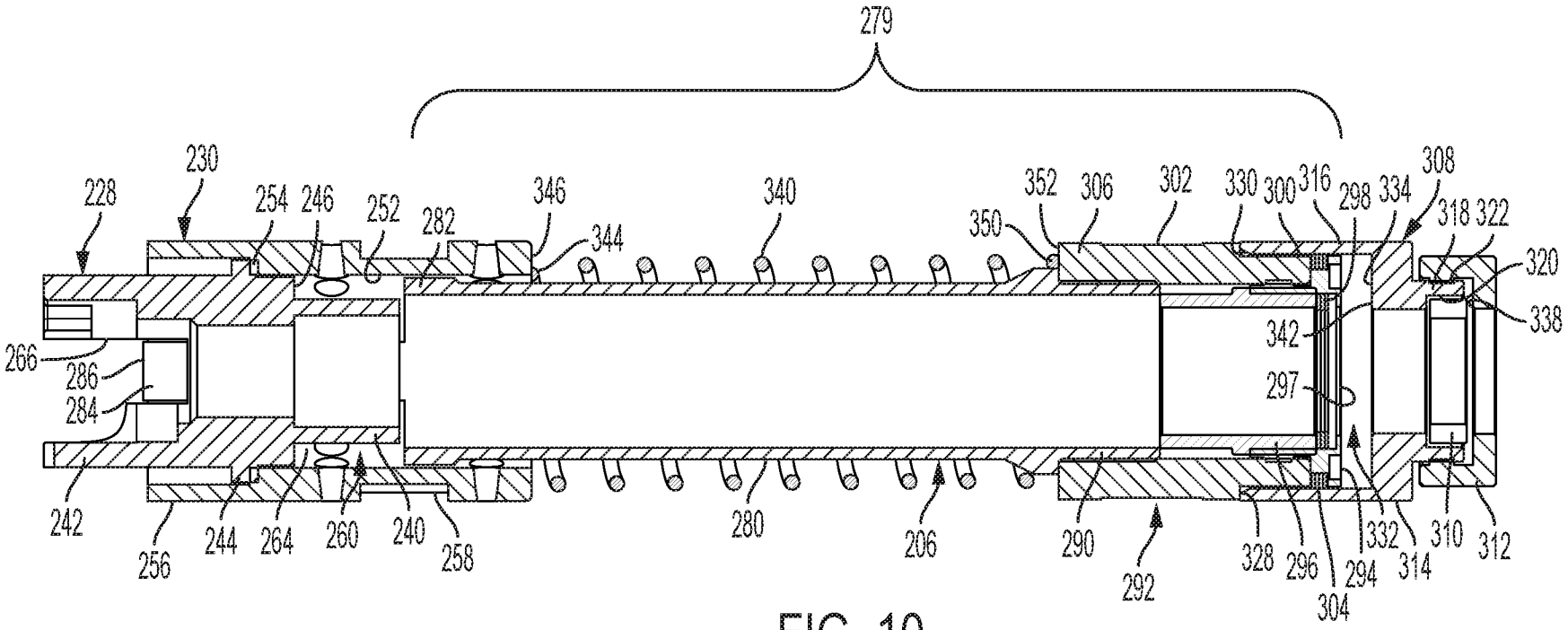
FIG. 10 is a cross section view of a gas piston assembly and barrel extension suitable for use within the exemplary upper receiver and barrel assembly shown in FIG. 3.

With reference to FIG. 10, barrel nut 230 may comprise a generally tubular member having a stepped inner wall 252 including a step 254 defining an upper receiving portion 256 and a gas piston assembly portion 258. Upper receiving portion 256 may include female threads configured to threadably engage male threads defined on forward barrel receiving end 250 of upper receiver body 208. In this manner, barrel nut 230 may be tightened onto upper receiver body 208 so as to capture barrel extension annular ring 244 between step 254 on barrel nut 230 and forward barrel receiving end 250 and secure barrel member 229 to upper receiver body 208. As will be discussed in greater detail below, a spaced distance 260 may be defined between inner wall 252 of gas piston assembly portion 258 of barrel nut 230 and outer wall surface 264 of barrel receiving portion 240 of barrel extension 228. Barrel extension 228 may further define opposing slots 266 which are configured to slidably receive gas piston assembly 206 as will described in greater detail below.

Figure 5:
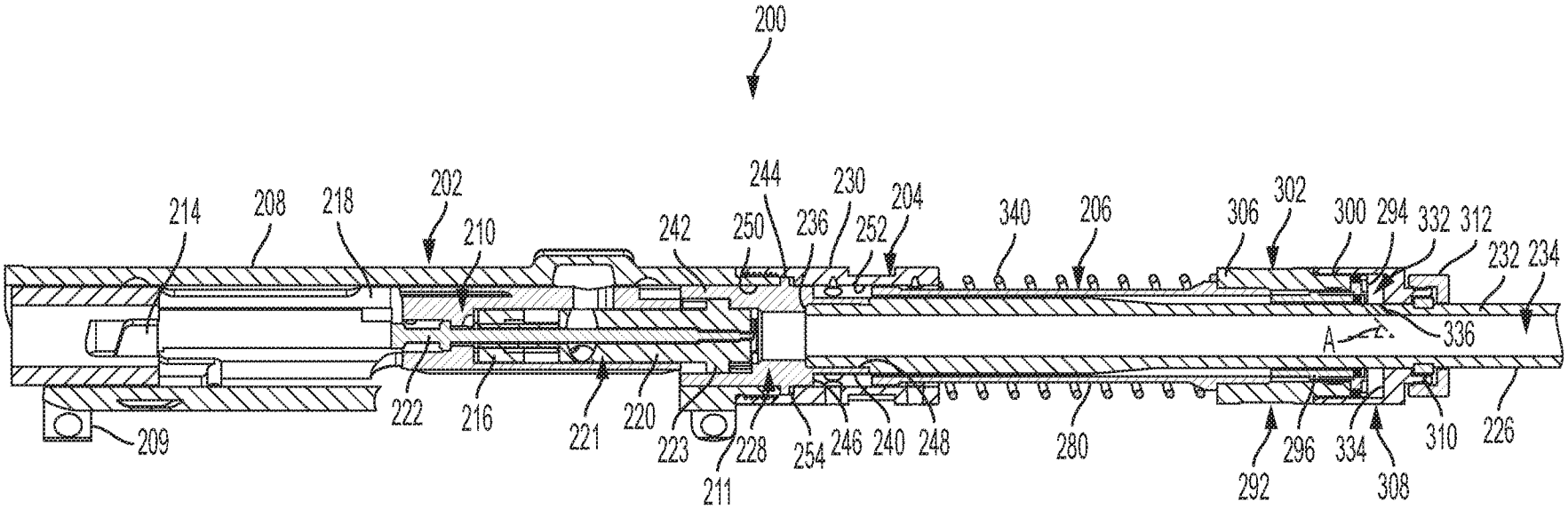
FIG. 5 is a partial cross-section view of the exemplary upper receiver and barrel assembly shown in FIG. 3.
Figure 12:
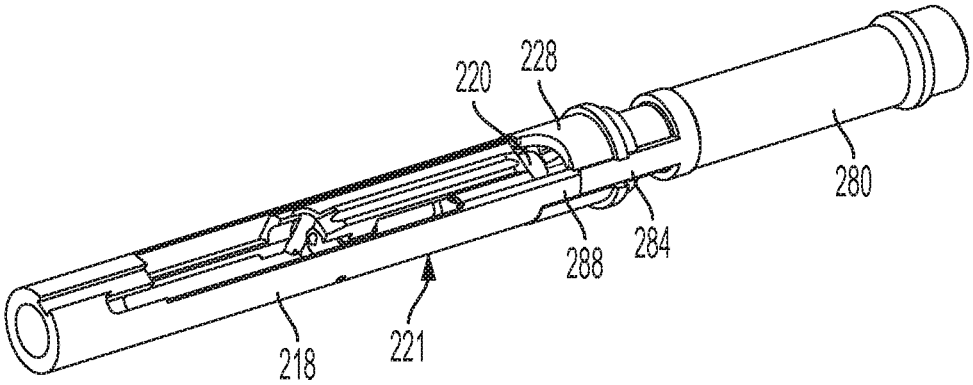
FIG. 12 is a perspective view of a gas piston body and bolt carrier group in the forward position prior to firing a shotgun shell.

Gas piston assembly 206 is configured to coaxially mount about barrel member 229 and includes a piston 279 generally comprised of a piston body 280 and piston head 292. First end 282 of piston body 280 includes one or more tabs 284 wherein each tab 284 is configured to be slidingly received within a respective slot 266 define within barrel extension 228. As will be discussed in greater detail below, terminal ends 286 of each tab 284 are configured to engage respective tangs 288 on bolt carrier 218 upon firing of the shotgun cartridge (see FIGS. 5, 7 and 12). In one aspect of the present invention, terminal ends 286 of each tab 284 abut against respective tangs 288 on bolt carrier 218 when bolt carrier 218 is in the forward position as shown in FIGS. 5, 7 and 12. In an alternative aspect of the present invention, terminal ends 286 of each tab 284 are a spaced distance away from its respective tang 288 when bolt carrier 218 is in the forward position but are driven into contact with its respective tang 288 by operation of the gas evolved upon firing of the shotgun shell cartridge, as will be discussed in greater detail below.

Second end 290 of piston body 280 fixedly receives piston head 292. Piston head 292 generally includes a piston end cap 294 coupled to a piston bushing 296 at a first end 295, such as through a threaded connection. One or more small gas rings 298 may be interposed between flange 297 of piston end cap 294 and piston bushing 296 so as to form a gas-tight seal therebetween. Small gas rings 298 also form a gas-tight seal between piston head 292 and barrel 226. First end 295 of piston end cap 294 (and piston bushing 296) may then be secured within a first end 300 of a piston coupling 302, such as through a threaded connection. One or more large gas rings 304 may be interposed between flange 297 of piston end cap 294 and piston coupling 302 so as to form a gas-tight seal therebetween. Second end 306 of piston coupling 302 may then be secured to second end 290 of piston body 280, such as through a threaded connection. In this manner, piston body 280 and piston head 292 may form a unitary body, i.e. piston 279.

To provide for reciprocal travel of piston 279, as will discussed in greater detail below, gas piston assembly 206 further includes a bonnet 308, retaining ring 310 and bonnet cap 312. Bonnet 308 includes a stepped sidewall 314 generally delineating a piston receiving portion 316 and bonnet cap receiving portion 318. Piston receiving portion 316 is configured to slidingly encircle first end 300 of a piston coupling 302, piston end cap 294 and large gas rings 304. Large gas rings 304 are proportioned so as to form a gas-tight seal between bonnet 308 and piston head 292. Bonnet cap receiving portion 318 includes a stepped internal face 320 configured to receive retaining ring 310 and a threaded external face 322 configured to threadably receive bonnet cap 312 thereon. A set screw 313 may releasably lock bonnet cap 312 on bonnet 308. Retaining ring 310 is configured to reside within an annular recess 324 defined by recess walls 326 along barrel 226 (see FIG. 4) and may be comprised of two generally C-shaped members. Retaining ring 310 may thus operate as a piston stop along the length of barrel 226. For instance, bonnet 308 is prevented from lateral travel toward muzzle end 238 through engagement of retaining ring 310 upon recess wall 326. Piston coupling 302, and thus piston 279, is in turn prevented from lateral travel toward muzzle end 238 by engagement of coupling step 328 of piston coupling 302 against terminal end 330 of bonnet 308.

As can be seen in FIGS. 5-10 and as will be discussed in greater detail below, a piston gap 332 is defined between flange 297 of piston end cap 294 and bonnet end wall 334. Piston gap 332 is positioned to coincide with a gas port 336 defined within barrel sidewall 232 so as to create a fluid pathway between open bore 234 and piston gap 332. The longitudinal axis of gas port 336 may be oriented at an angle A with respect to the longitudinal axis of bore 234 of barrel 226. In one aspect of the present invention, angle A is selected to be between about 5° and about 90°, between about 30° and about 60°, or about 45°, although any angle may be defined so long as gas port 336 operates in accordance with the teachings of the present invention, as will be discussed in greater detail below.

Lateral travel of bonnet 308 toward receiver end 236 is prevented by the threaded engagement of bonnet cap 312 to bonnet 308 and the interference of retaining ring 310 against internal face 338 of bonnet cap 312. However, piston 279 is free to slidably translate along barrel 226 toward receiver end 236 as will be discussed in greater detail below. To that end, a biasing member, such as piston spring 340, may urge piston 279 toward the inner surface 342 of bonnet end wall 334. For instance, first end 344 of piston spring 340 may rest upon end face 346 of barrel nut 230 while second end 350 may rest against end face 352 of piston coupling 302.

Figure 11:
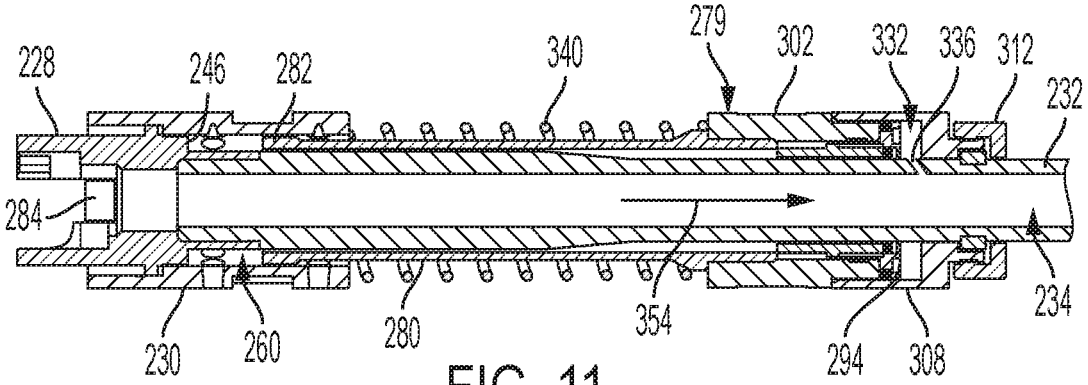
FIG. 11 is a cross section view of a gas piston assembly and barrel assembly wherein the bolt carrier group is in the forward position prior to firing a shotgun shell.
Figure 13:
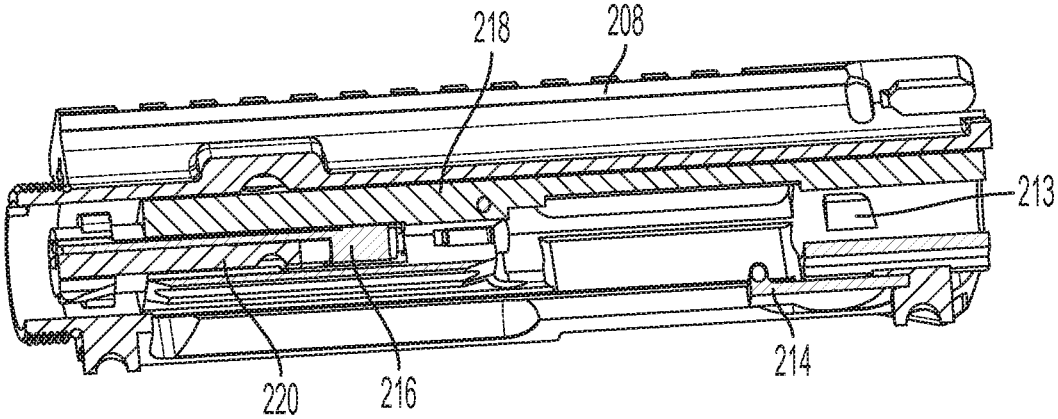
FIG. 13 is a cross section view of an upper receiver housing and bolt carrier group in the forward position prior to firing a shotgun shell.

Turning now to FIGS. 11-19, operation of the various features of the exemplary upper receiver and barrel assembly 200 are shown. With reference to FIGS. 11-13, the firearm is loaded with a shotgun shell cartridge (not shown) and is ready to be fired. That is, the rimmed edge of a .410 bore shotgun shell cartridge is received within rim gap 245*a*, 245*b* such that the primer end of the sell cartridge lies flush against bolt head face 247 (see e.g., FIGS. 8 and 11). As shown, piston 279 is in the forward position with coupling step 328 contacting terminal end 330 of bonnet 308 and tabs 284 of piston 279 contacting tangs 288 on bolt carrier 218. However, as described above, tabs 284 of piston 279 may initially be a spaced distance from tangs 288 on bolt carrier 218. Upon firing of the shotgun shell cartridge, such as through actuation of the trigger (not shown, see e.g., FIGS. 1 and 2) to drive firing pin 222 into the primer end of the cartridge (not shown), a volume of hot, high pressure gas 354 is evolved. High pressure gas 354 travels down barrel 226 toward muzzle end 238 and operates to propel and expel the shotgun shell contents (i.e., bird shot, buckshot or slugs) out of barrel 226.

Figure 14:
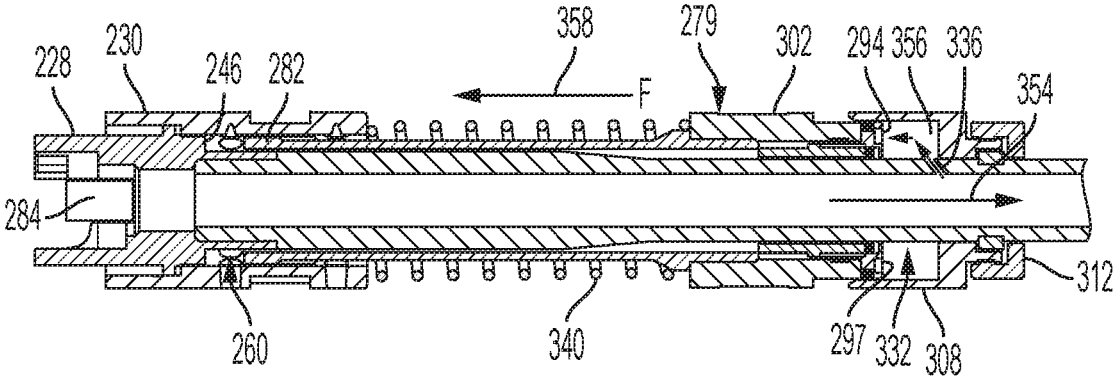
FIG. 14 is a cross section view of a gas piston assembly and barrel assembly an intermediate time following firing a shotgun shell.
Figure 15:
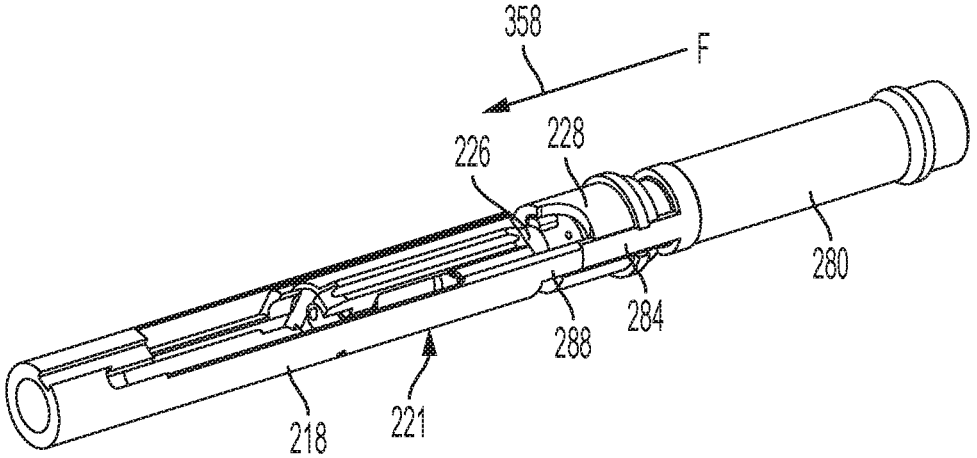
FIG. 15 is a perspective view of a gas piston body and bolt carrier group an intermediate time following firing a shotgun shell.
Figure 16:
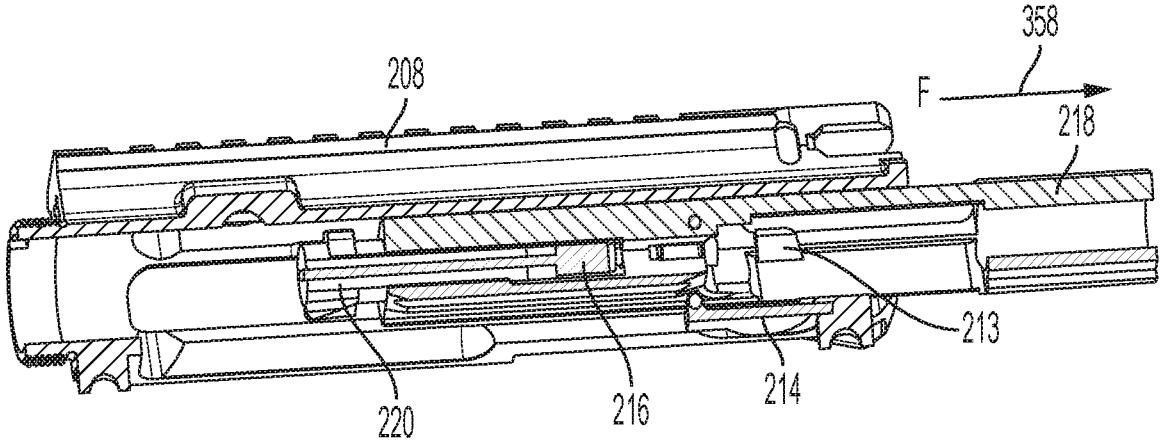
FIG. 16 is a cross section view of an upper receiver housing and bolt carrier group an intermediate time following firing a shotgun shell.

With reference to FIGS. 14-16, as high pressure gas 354 travels down barrel 226, a portion 356 of the gas is directed into piston gap 332 by way of gas port 336. Gas portion 356 impinges upon flange 297 of piston end cap 294. The pressure of gas portion 356 is sufficient to overcome the biasing force of piston spring 340 such that piston 279 translates toward receiver end 236 in direction F as generally indicated by arrow 358. Travel of piston 279 causes potential energy to be stored within piston spring 340. As tabs 284 engage tangs 288 of bolt carrier 218, bolt carrier group 221 is also translated in direction F within upper receiver body 208. The fired, empty shell travels with bolt carrier group 221 as the rimmed edge of the shell is still captured within rim gap 2454*a*, 245*b* formed by cartridge guide 233 and extractor 235. In accordance with an aspect of the invention, gas port 356 is configured to be at about a 45° angle toward receiver end 236. Gas port 356 may have an internal diameter between about 0.0625 inches and about 0.125 inches, or between about 0.090 inches and 0.095 inches. In this manner, a suitable volume and pressure of gas portion 356 may be introduced into piston gap 332.

Figure 17:
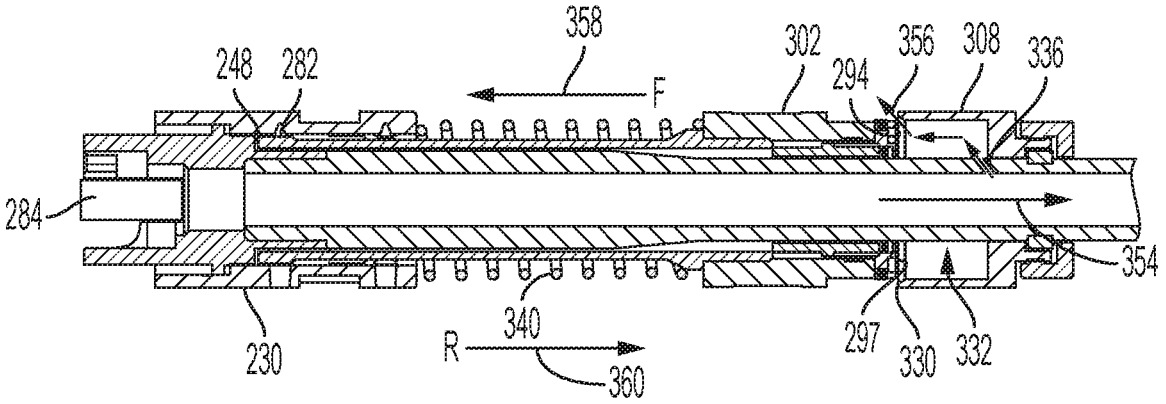
FIG. 17 is a cross section view of a gas piston assembly and barrel assembly illustrating full travel of the gas piston assembly following firing a shotgun shell.
Figure 18:
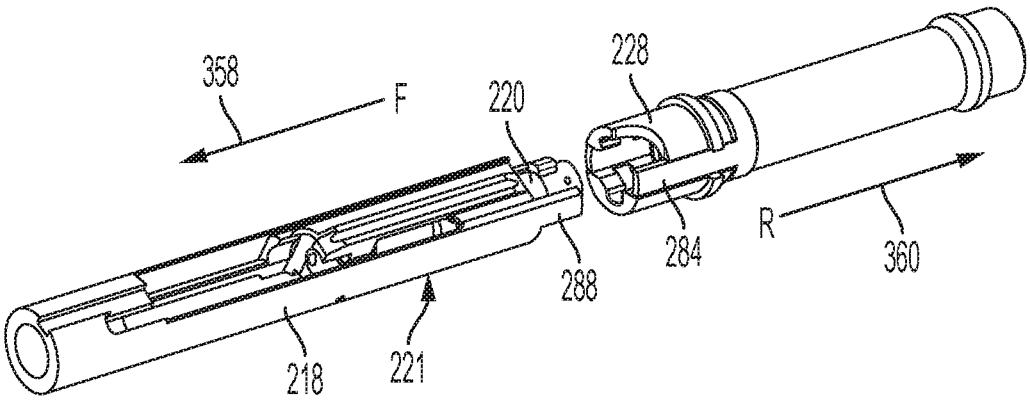
FIG. 18 is a perspective view of a gas piston body and bolt carrier group showing decoupling of the bolt carrier group from the barrel extension following firing a shotgun shell.
Figure 19:
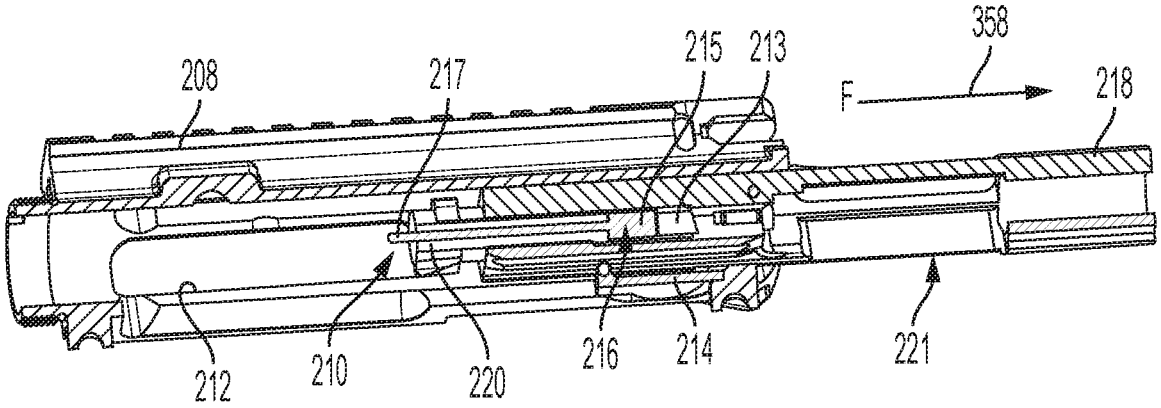
FIG. 19 is a cross section view of an upper receiver housing and bolt carrier group following firing a shotgun shell wherein the ejection pin has engaged the ejection hook to eject the fired shotgun shell from the chamber.

As shown in FIGS. 17-19, gas portion 356 continues to translate piston 279 and bolt carrier group 221 in direction F until piston end cap 294 clears terminal end 330 of bonnet 308 whereby gas portion 356 may vent to atmosphere. Travel of piston 279 in direction F may also be halted by physical engagement of first end 282 of piston body 280 against step 246 of barrel extension 228 (i.e., gap 260 is closed); see FIG. 17. Upon venting of gas portion 356, piston 279 may then return to the forward position by traveling in opposing direction R as indicated generally by arrow 360 due to the release of the stored potential energy in piston spring 340. First end 300, large gas rings 304 and piston end cap 294 of piston 279 may then reset within bonnet 308 as described above in preparation of firing the next shotgun cartridge.

While piston 279 is reset as described above, bolt carrier group 221 may unlock from barrel extension 228 (FIG. 18), such as through rotation of cam 258 in carrier slot 227 (see FIG. 4), and thereby continue to travel in direction F due to inertia (along with the fired, empty shell). Continued travel of bolt carrier group 221 in direction F causes ring portion 215 of ejector pin 216 to engage flange 213 of ejector hook 214 while the remainder of bolt carrier group 221 continues to travel in direction F. As a result, pin extension 217 of ejector pin 216 may then extend outwardly of bolt 220 into chamber 210 so as to engage the rimmed edge of the fired, empty shotgun shell (not shown). In one aspect of the invention, ejector pin 216 engages the rimmed edge of the fired, empty shotgun shell proximate cartridge guide 233 so as to apply a force off-center from the central axis of the shotgun shell. Application of force against one side of the shell may cause the rimmed edge to slip past extractor 235 so as to "flip" the used shell from the bolt. In this manner, the fired shotgun shell may be ejected through ejection port 212. In another aspect of the invention, extractor 235 may pivot about extractor pin 237, thereby compressing extractor spring 239 and opening rim gap 245*a* so as to assist ejection of the fired, empty shotgun shell. Once the shell has been ejected, the potential energy within the compressed extractor spring may be released, thereby returning extractor 235 to its original position.

Travel of bolt carrier group 221 in direction F against a buffer spring housed within the buttstock assembly (see e.g., FIGS. 1 and 2) causes potential energy to be stored within the buffer spring, as is known in the art. Once the inertial energy of bolt carrier group 221 equals the compression force of the buffer spring, travel of bolt carrier group 221 in direction F is arrested. The buffer spring may then release its stored potential energy so as to redirect bolt carrier group 221 in the opposing direction R. As bolt carrier group 221 travels in direction R, bolt 220 may then extract the next available shotgun shell cartridge from the magazine (not shown, see e.g., FIG. 2). Bolt carrier group 221 continues to travel in direction R until the new, live shotgun shell cartridge is seated within the chamber and bolt 220 reseats within barrel extension 228 as shown in FIGS. 5 and 6, such as through reverse rotation of cam 258 in carrier slot 227 and locking of detents 223 on bolt 220 within T-shaped grooves 243 defined by barrel extension 228 (see e.g., FIG. 7).

Simultaneously, cartridge guide 233 and extractor 235 are driven against the rimmed end of the new, live shotgun shell cartridge such that the rimmed edge travels down the ramped face of hooks 233*a*, 235*a* until the rimmed edge slides past the hooks and rests within rim gap 245*a*, 245*b*. Again, extractor 235 may pivot about extractor pin 237, thereby compressing extractor spring 239 and opening rim gap 245*a* so as to assist seating of the new, live shotgun shell cartridge within rim gap 245*a*, 245*b*. Once the shell has been seated in the gap, the potential energy within the compressed extractor spring may be released, thereby returning extractor 235 to its original position whereby extractor hook 235*a* captures the rimmed edge. Should bolt 220 fail to reseat properly within barrel extension 228, the user may use forward assist 224 to manually push bolt 220 in direction R until proper seating is achieved. The firearm is then ready to fire the newly loaded shotgun shell cartridge so as to repeat the above progression.

In accordance with an aspect of the present invention, to facilitate cleaning of the firearm, including upper receiver 202 and bolt carrier group 221, ejector hook 214 may be pivotally mounted in upper receiver 202 such that ejector flange 213 may be pivotally withdrawn from bolt carrier 218 so that bolt carrier group 221 may be slidably removed from upper receiver 202 without requiring removal of ejector hook 214. Upper receiver 202 and bolt carrier group 221 may then be cleaned and maintained in accordance with the art.

In view of the above, it should be further recognized that specifications of the various components must be tightly controlled to ensure proper operation of the firearm, such as and without limitation thereto, the weight, density, surface contact/friction, gap dimension and location, and spring constants.

For instance, as described above, to ensure proper cycling of piston 279 and bolt carrier group 221, gas port 336 must be dimensioned, located and oriented such that sufficient gas volume and pressure is delivered to piston 279 to impart the needed kinetic energy to bolt carrier group 221. Piston head 292 must also be properly sealed within bonnet 308 to minimize, and preferably prevent, leakage of gas portion 356 prior to the complete travel of piston 279 and venting of gas portion 356 as described above. Accordingly, the length of piston receiver portion 318 of bonnet 308 and the length of gap 260 must be proportioned such that piston 279 may sufficiently impart enough kinetic energy to bolt carrier group 221 while also allowing piston 279 to be reset within bonnet 308 prior to firing of the next successive shotgun shell cartridge. By way of example, if either the length of piston receiver portion 318 or gap 260 is too short, piston 279 will not provide sufficient kinetic energy to bolt carrier group 221 to permit ejection of the fired shotgun shell and extraction of the next successive cartridge from the magazine. However, should the length of gap 260 be too long, piston head 292 may travel too far in direction F such that it may not sufficiently reset within bonnet 308 prior to firing of the next shotgun shell cartridge. As a result, the gas portion introduced upon firing of the next shotgun shell cartridge would not provide sufficient volume and/or pressure of gas to piston 279, which in turn would lead to insufficient cycling of bolt carrier group 221. Conversely, if the length of piston receiver portion 318 is too long, piston head 292 will never clear terminal end 330 of bonnet 308 such that gas portion 356 will not vent to atmosphere. As a result, piston 279 will be prevented from resetting within bonnet 308, thereby rendering the firearm unusable.

Similarly, as described above, the spring constant for each of the buffer spring and piston spring 340 must be selected to enable proper cycling of bolt carrier group 221 and piston 279. That is, the size and spring constant of the buffer spring must be such that the spring constant is low enough that bolt carrier group 221 may travel sufficiently in direction F so as to eject the fired shotgun shell, but be high enough to recycle bolt carrier group 221 in direction R to extract the next successive shotgun shell cartridge and reseat bolt 220 in barrel extension 228 while also preventing bolt carrier group 221 from violently striking the buttstock. The size and spring constant of piston spring 340 must be such that the spring constant is low enough that piston 279 may travel sufficiently in direction F so as to impart the needed kinetic energy to bolt carrier group 221 while also being high enough to reset piston head 292 within bonnet 308 as described above.

Although the present invention has been described in considerable detail with reference to certain aspects thereof, other versions are possible. Therefore, the spirit and scope of the appended claims should not be limited to the description of the aspects contained herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. An upper receiver and barrel assembly configured to mount to a lower receiver and receive and fire a shotgun shell cartridge, the upper receiver and barrel assembly comprising:

a) an upper receiver comprising:

i) an upper receiver housing defining a chamber configured to receive the shotgun shell cartridge therein; and ii) a bolt carrier group including:

a) a bolt carrier slidably received within the upper receiver housing, wherein the bolt carrier travels from a forward position to a rearward position upon firing of the shotgun shell cartridge;

b) a bolt received within the bolt carrier; and c) a firing pin configured to strike a primer end of the shotgun shell cartridge when the bolt carrier is in the forward position;

b) a barrel assembly comprising:

i) a barrel having a receiver end and a muzzle end and a tubular sidewall defining an open bore;

ii) a barrel extension coupling the receiver end of the barrel to the upper receiver housing; and c) a gas piston assembly comprising:

i) a piston including:

a) a piston body having a first end and a second end, wherein the first end of the piston body includes one or more tabs slidably received within corresponding slots defined by the barrel extension;

b) a piston end cap coupled to the second end of the piston body;

ii) a piston bonnet having a bonnet end wall and a sidewall configured to slidably receive the piston end cap therein, wherein the piston bonnet is secured to the barrel an intermediate distance between the receiver end and the muzzle end of the barrel, wherein a piston gap is defined between the piston end cap and the bonnet end wall, and wherein the barrel sidewall defines a gas port fluidly connecting the open bore of the barrel with the piston gap; and iii) a biasing member urging the piston body and piston end cap toward the bonnet end wall.

2. The upper receiver and barrel assembly according to claim 1, wherein the bolt carrier group further includes:

d) an ejector assembly including an ejector pin and an ejector hook, wherein the ejector assembly is configured to expel the fired shotgun shell from the chamber when the bolt carrier travels to the rearward position.

3. The upper receiver and barrel assembly according to claim 1, wherein the bolt further includes an extractor pivotally mounted on the bolt, wherein the extractor is configured to releasably receive a rimmed edge of the shotgun shell cartridge.

4. The upper receiver and barrel assembly according to claim 2, wherein the bolt further includes a cartridge guide and an opposing extractor configured to releasably receive a rimmed edge of the shotgun shell cartridge, wherein the cartridge guide is integrally formed with the bolt and the extractor is pivotally mounted on the bolt, and wherein the ejector pin is configured to translate within the bolt parallel to the longitudinal axis of the bolt proximate the cartridge guide.

5. The upper receiver and barrel assembly according to claim 1, wherein the barrel assembly further includes:

iii) a barrel nut adapted to releasably secure the barrel and barrel extension to the upper receiver housing.

6. The upper receiver and barrel assembly according to claim 1, wherein the longitudinal axis of the gas port is at an angle relative to the longitudinal axis of the barrel.

7. The upper receiver and barrel assembly according to claim 6, wherein the angle is between 1° and 90° toward the receiver end of the barrel.

8. The upper receiver and barrel assembly according to claim 6, wherein the angle is between 30° and 60° toward the receiver end of the barrel.

9. The upper receiver and barrel assembly according to claim 6, wherein the angle is 45° toward the receiver end of the barrel.

10. The upper receiver and barrel assembly according to claim 1, wherein the piston further includes:

c) a piston bushing coupling the second end of the piston body to the piston end cap; and d) a piston coupling receiving the second end of the piston body, the piston bushing and a portion of the piston end cap therein, wherein the piston body, the piston end cap, the piston bushing and the piston coupling form a unitary member.

11. The upper receiver and barrel assembly according to claim 10, wherein the piston further includes:

e) one or more small gas seals between the piston bushing and the piston end cap; and f) one or more large gas seals between the piston end cap and the piston coupling, wherein the piston body, the piston end cap, the piston bushing, the piston coupling, the small gas seals and large gas seals form a unitary member.

12. The upper receiver and barrel assembly according to claim 1, wherein the gas piston assembly further includes:

iv) a retaining ring received within an annular recess defined within the barrel; and v) a bonnet cap securing the piston bonnet to the retaining ring and the barrel.

13. The upper receiver and barrel assembly according to claim 1, wherein the upper receiver is configured to mount to an AR-15 lower receiver.

14. The upper receiver and barrel assembly according to claim 13, wherein the AR-15 upper receiver includes a modified ejection port configured to allow ejection of the fired shotgun shell therethrough.

15. The upper receiver and barrel assembly according to claim 13, wherein the bolt carrier group further includes:

d) an ejector assembly including an ejector pin and an ejector hook, wherein the ejector assembly is configured to expel the fired shotgun shell from the chamber when the bolt carrier travels to the rearward position, and wherein the ejector hook is pivotally mounted onto the AR-15 upper receiver.

16. An upper receiver and barrel assembly configured to mount to an AR-15 lower receiver and receive and fire a shotgun shell cartridge, the upper receiver and barrel assembly comprising:

a) an upper receiver comprising:

i) an upper receiver housing defining a chamber configured to receive the shotgun shell cartridge therein and a modified ejection port configured to allow ejection of a fired shotgun shell therethrough; and ii) a bolt carrier group including:

a) a bolt carrier slidably received within the upper receiver housing, wherein the bolt carrier travels from a forward position to a rearward position upon firing of the shotgun shell cartridge;

b) a bolt received within the bolt carrier, wherein the bolt includes a cartridge guide and an opposing extractor configured to releasably receive a rimmed edge of the shotgun shell cartridge, wherein the cartridge guide is integrally formed with the bolt and the extractor is pivotally mounted on the bolt;

c) a firing pin configured to strike a primer end of the shotgun shell cartridge when the bolt carrier is in the forward position; and d) an ejector assembly including an ejector pin and ejector hook, wherein the ejector pin is configured to translate within the bolt parallel to the longitudinal axis of the bolt proximate the cartridge guide to expel the fired shotgun shell from the chamber through the ejection port when the bolt carrier travels to the rearward position and wherein the ejector hook is pivotally mounted onto the upper receiver;

b) a barrel assembly comprising:

i) a barrel having a receiver end and a muzzle end and a tubular sidewall defining an open bore;

ii) a barrel extension coupling the receiver end of the barrel to the upper receiver housing; and iii) a barrel nut adapted to releasably secure the barrel and barrel extension to the upper receiver housing; and c) a gas piston assembly comprising:

i) a piston including:

a) a piston body having a first end and a second end, wherein the first end of the piston body includes one or more tabs slidably received within corresponding slots defined by the barrel extension;

b) a piston end cap coupled to the second end of the piston body;

c) a piston bushing coupling the second end of the piston body to the piston end cap;

d) a piston coupling receiving the second end of the piston body, the piston bushing and a portion of the piston end cap therein;

e) one or more small gas seals between the piston bushing and the piston end cap; and f) one or more large gas seals between the piston end cap and the piston coupling, wherein the piston body, the piston end cap, the piston bushing, the piston coupling, the small gas seals and large gas seals form a unitary member;

ii) a piston bonnet having a bonnet end wall and a sidewall configured to slidably receive the piston end cap therein, wherein the piston bonnet is secured to the barrel an intermediate distance between the receiver end and the muzzle end of the barrel, wherein a piston gap is defined between the piston end cap and the bonnet end wall, and wherein the barrel sidewall defines a gas port fluidly connecting the open bore of the barrel with the piston gap, wherein the longitudinal axis of the gas port is at a 45° angle relative to the longitudinal axis of the barrel toward the receiver end of the barrel;

iii) a biasing member urging the piston body and piston end cap toward the bonnet end wall;

iv) a retaining ring received within an annular recess defined by the barrel; and v) a bonnet cap securing the piston bonnet to the retaining ring and the barrel.

* * * * *